US006543647B1

(12) United States Patent
Buchholz

(10) Patent No.: US 6,543,647 B1
(45) Date of Patent: Apr. 8, 2003

(54) METHOD AND DEVICE FOR DOSING AND MIXING DIFFERENT COMPONENTS

(75) Inventor: Norbert Buchholz, Bielefeld (DE)

(73) Assignee: Graco Inc., Minneapolis, MN (US)

( * ) Notice: Subject to any disclaimer, the term of this patent is extended or adjusted under 35 U.S.C. 154(b) by 0 days.

(21) Appl. No.: 09/807,849

(22) PCT Filed: Oct. 10, 1999

(86) PCT No.: PCT/EP99/07586

§ 371 (c)(1),
(2), (4) Date: Jun. 25, 2001

(87) PCT Pub. No.: WO00/24522

PCT Pub. Date: May 4, 2000

(30) Foreign Application Priority Data

Oct. 22, 1998 (DE) ..... 198 48 640

(51) Int. Cl.[7] ..... B67D 5/60
(52) U.S. Cl. ..... 222/134; 222/145.6
(58) Field of Search ..... 239/112; 222/134, 222/145.6, 504, 144.5

(56) References Cited

U.S. PATENT DOCUMENTS 3,802,605 A * 4/1974 Standick ..... 222/134
4,154,368 A * 5/1979 Gusmer et al. ..... 222/146.5
4,285,446 A * 8/1981 Rapp et al. ..... 239/112

* cited by examiner

*Primary Examiner*—Philippe Derakshani
(74) *Attorney, Agent, or Firm*—Douglas B. Farrow

(57) ABSTRACT

In a method for metering and mixing different components, more particularly resin and hardener, and for delivery through a spray device (6), with a first component standing under a preliminary pressure, a second component standing under a preliminary pressure and a solvent standing under preliminary pressure for the first component, the components flowing in through valves are detected through quantity measuring devices (8; 9) and supplied first to a mixer device (7) and then to the spray device (6). The one component is supplied in a predetermined quantity and the amount of the other component is controlled in dependence on the quantity of the one component by controlling the opening time of a shut-off valve (1*b*; 2*b*). Selectively the first or second component is controlled and the other component is supplied in a predetermined quantity.

12 Claims, 1 Drawing Sheet

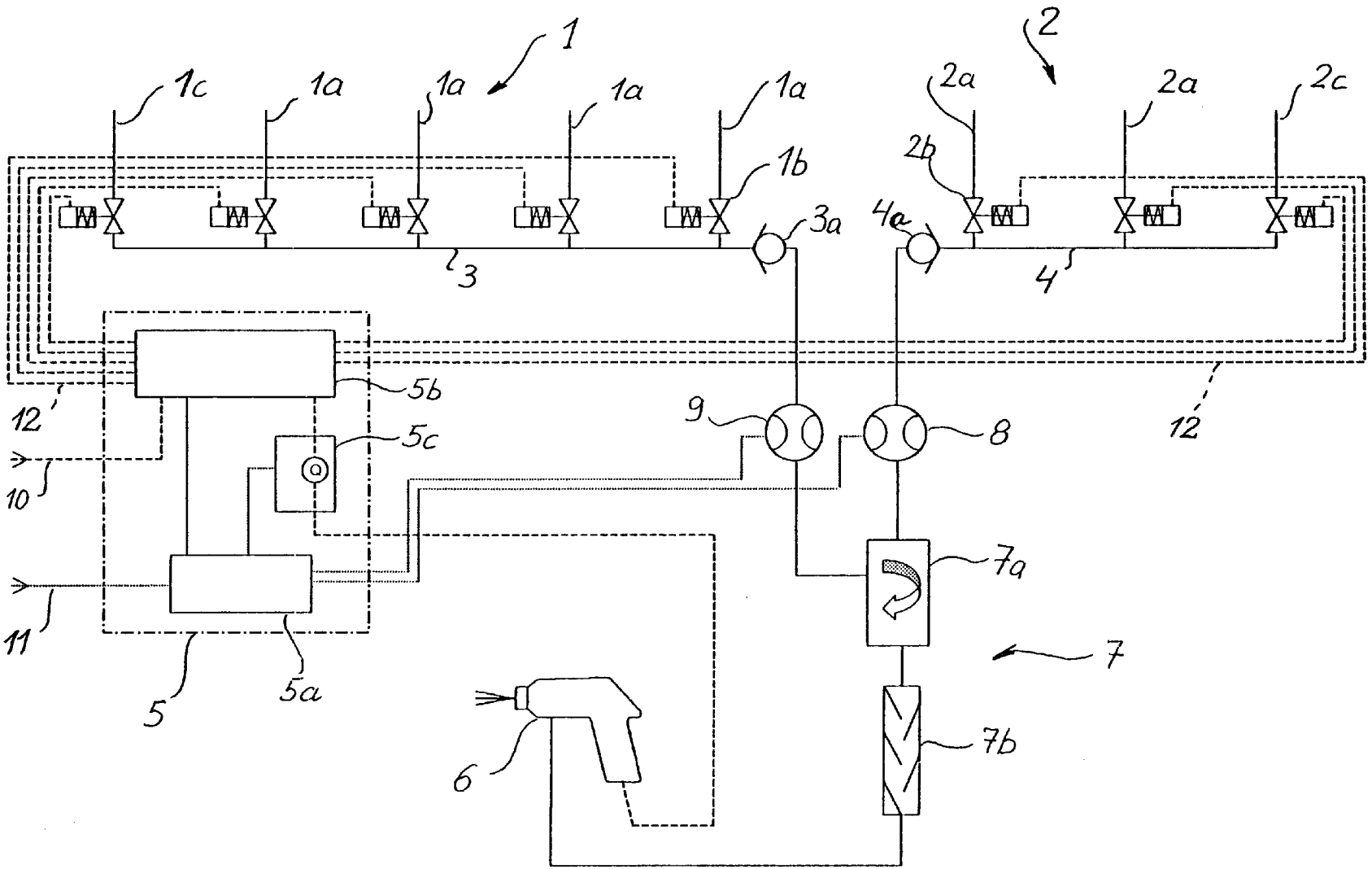
2c
2a
2
2a
2b
4
4a
12
8
7a
7
7b
3a
1a
1b
1a
1
1a
1a
1c
3
9
6
5b
5c
5a
5
12'
10
11

METHOD AND DEVICE FOR DOSING AND MIXING DIFFERENT COMPONENTS

TECHNICAL FIELD

The invention relates to a method for metering and mixing different components according to the preamble of patent claim 1 as well as to an apparatus for carrying out this method.

PRIOR ART

With a known method of this kind (U.S. Pat. No. 5,464,283 A) a resin which forms the first component is continuously supplied in a predetermined quantity. The quantity of the continuously flowing paint stream is monitored and the required amount of a second component, namely solvents, is measured and introduced into a mixer in a predetermined ratio. The amount of solvent is controlled through valves and added in a predetermined ratio to the constant resin quantity which is measured by a through-flow meter. The resin and solvent are introduced together into the mixer in a predetermined fixed ratio.

It is absolutely essential to the functioning reliability of the method that the pressure of the solvent has always to be above the pressure of the resin.

With the known prior art there is always a specific differential pressure ratio maintained between the resin and the solvent. The corresponding differential pressure regulation serves especially to match the solvent pressure in dependence on the resin pressure. If through any type of influencing factor, for example through contamination or impurities it happens that the solvent pressure drops down to the pressure of the resin or below then the delivery process has to be terminated because the selected mixing ratio can no longer be observed in such an operating situation.

Two components are added to the resin in succession, namely a solvent and a hardener. After the resin is mixed with the solvent it forms a new starting component which is introduced into a second mixer as a new first component in a predetermined quantity. Also adding hardeners in the second mixer to the first component which is made up of the solvent and resin can only be carried out by introducing the first component from the first mixer in a predetermined quantity into the second mixer whilst the quantity of hardener is supplied into the second mixer in a correspondingly controlled or regulated manner. Also with this second method step the first component has always to be supplied constantly and the second component matched with this. Here also the delivery process has to be terminated if the selected mixing ratio cannot be observed in certain operating situations where the pressure of the hardener drops below the pressure of the first component.

There is also the fundamental drawback that the amount of hardener which is required is always metered in dependence on the associated amount of resin. During most of the operating time the amount of resin is therefore above the amount of hardener preset by the mixing ratio. This drawback is particularly damaging in the case of short spray intervals. It can only be overcome by a metering control with subsequent correction of the mixing ratio.

THE INVENTION

Starting from the prior art the object of the invention is to provide a method of the type already presumed known so that it is less susceptible to breakdown and the apparatus required for its implementation is functionally reliable so long as the components to be metered can be supplied, namely independently of which pressures prevail in the pipelines, which pressure differences are set and which viscosities the components have which are being metered.

This is achieved with the features of patent claim 1 and with an apparatus according to patent claim 5.

With the method according to the invention the quantities of the two components are regulated by pneumatically controlled valves. It is sufficient for the pneumatically controlled valves to only occupy two operating states, namely an opening position and a closing position. Each of the two pneumatically controlled valves then remains open until the predetermined amount corresponding to the desired mixing ratio has flowed through. It can be arranged so that the valve then still remains in the open position for a preset additional time. A deviation then takes place from the predetermined mixing ratio in the case of two components in the direction both of an excess of hardener and shortfall of hardener. At the start of metering the quantities of the two components are added up and corrected according to the mixing ratio set. The percentage deviation of the metering amount from the ideal value is constantly reduced through the growing overall amount.

Preferred designs of the invention are apparent from the sub-claims.

BRIEF DESCRIPTION OF THE DRAWINGS

A preferred embodiment of the invention will now be described in detail with reference to the drawing which shows a diagrammatic view of a metering and mixing device for resins and hardeners.

BEST METHOD OF IMPLEMENTING THE INVENTION

A resin supply 1 has various paint supply pipes 1*a* and a solvent supply pipe 1*c*. The paint supply pipes 1*a* are connected to supply containers (not shown) which are set under a preliminary pressure. The solvent supply pipe (1*c*) is connected to a solvent supply container (not shown).

A hardener supply 2 has two hardener supply pipes 2*a* and a solvent supply pipe 2*c*. These pipes all open into a supply line 4. The two hardener supply pipes 2*a* are connected to supply containers (not shown) for hardener standing under a preliminary pressure, and the solvent supply pipe 2*c* is connected to a solvent supply container (not shown).

The preliminary pressure in the resin supply 1 and in the hardener supply 2 can be produced by conveyor pumps (not shown).

The supply pipes 3 and 4 open into a mixer device 7 to which a spray device 6 is attached. The mixer device 7 consists of a torsion mixer 7*a* and a static mixer 7*b* connected in on the output side.

The resin supply 1 and the hardener supply 2 are controlled by a regulating device 5 which opens and closes one of the paint supply pipes 1*a* which are to be selected and one of the hardener supply pipes 2*a*. A pneumatically operable shut-off valve 1*b* is provided for this in each of the paint supply pipes 1*a* and solvent supply pipe 1*c*.

Corresponding pneumatically operated shut-off valves 2*b* are provided in the hardener supply pipes 2*a* and the solvent supply pipe 2*c*.

The shut-off valves 1*b* and 2*b* are operable through compressed air pipes 12 which are connected to a common supply line 10 by means of magnetic valves 5*b*, which are only shown diagrammatically.

The supply line 10 also supplies the compressed air for the spray device 6 which in the illustrated embodiment is a spray gun. The compressed air for the spray device 6 is supplied through one of the multiple magnetic valves which are all marked 5*b*. The amount of air supplied to the spray device 6 is regulated through a flow meter 5*c* of the regulating device which is marked overall by 5. The magnetic valves 5*b* are operated by a memory-programmable electronic control unit 5*a* which is supplied with power through a cable 11. The conversion of the electric signals into a compressed air control is particularly advisable owing to the risk of explosion when handling paints.

A non-return valve 3*a* and a quantity measuring device 9 are mounted in the supply pipe 3. The supply pipe 4 has a non-return valve 4*a* and a quantity measuring device 8. The signals produced by the quantity measuring devices 8 and 9 are transferred to the memory-programmable control unit 5*a* and serve to control the different magnetic valves 5*b* according to the program laid down in the control unit 5*a*.

After opening the spray device 6, for example by drawing on a lever, the selected paint supply pipe 1*a* is opened through the associated shut-off valve 1*b* so that a quantity of paint predetermined by the regulating device 5 flows through the supply pipe 3. The quantity of paint supplied per time interval is measured by the quantity measuring device 9. The signal from the quantity measuring device 9 transferred to the control unit 5*a* causes the control to open the shut-off valve 2*b* of the selected hardener pipe 2*a* so that to the paint flowing into the mixer device 7 is added a quantity of hardener which corresponds to the predetermined ratio of paint to hardener. As soon as an excess of hardener is detected by the quantity measuring device 8 the regulating device 5 closes the valve 2*b* until as a result of the then sole supply of paint further hardener is again required and supplied. In this way the desired mixing ratio is always accurately produced in the mixer device.

If as a result of faults, such as for example those caused by fluctuations in viscosity, temporary contamination or the like the mixing ratio which is to be formed with the continuously supplied paint cannot be observed despite a constantly opened shut-off valve 2*b*, then the supply of paint is interrupted by closing the previously opened valve 1*b* until a sufficient amount of hardener is flowing through. In this case the amount of paint delivered is thus matched to the amount of hardener delivered. As opposed to the operating state previously described then the signal detected by the quantity measuring device 8 for the amount of hardener thus becomes the guide value which the amount of paint follows as regulating value. As a result of this functioning principle which can make both the amount of hardener and the amount of paint into the guide value and each other value into the regulating value, pressure fluctuations can be compensated both in the resin supply 1 and in the hardener supply 2, and similarly fluctuations in the viscosity and consistency in both media.

The apparatus thus remains able to function so long as the components can be supplied. In this way short-term faults which up until now frequently required the apparatus to be shut down can now be overcome without interrupting operation.

What is claimed is:

1. Method for metering and mixing different components, more particularly resin and hardener, and for delivering same through a spray device (6), with a first component standing under a preliminary pressure, a second component standing under a preliminary pressure and a solvent for the first component also standing under a preliminary pressure, wherein components flowing in through valves are detected by quantity measuring devices (8, 9), supplied first to a mixer device (7) and then to the spray device (6), wherein the one component is supplied in a predetermined quantity and the amount of the other component is supplied controlled in dependence on the quantity of the one component through controlling the opening time of a shut-off valve (1*b*; 2*b*), characterised in that selectively the first or the second component is controlled and the relevant other component is supplied in a predetermined quantity.

2. Method according to claim 1 characterised in that the amount of the two components supplied is constantly measured, added up and constantly compared with the targets.

3. Method according to claim 1 or 2 characterised in that the two components can be metered with a predetermined slowing down time which exceeds the precise metering time corresponding to the predetermined quantity.

4. Method according to one or more of claims 1 to 3 characterised in that a change of components from the guide value into the regulating value takes place as soon as the amount of the component being matched runs in continuously.

5. Apparatus for carrying out the method according to claim 1 having at least two supply pipes standing under a delivery pressure for two components, two quantity measuring devices (8; 9), a mixer (7) into which the two components are introduced, and a regulating device (5) which regulates according to a predetermined mixing ratio the quantities of one component through a shut-off valve (2*b*) in dependence on the measured quantity of the other component, characterised in that the regulating device (5) is formed for regulating also the quantity of the other component in dependence on the measured quantity of the one component and regulates a further shut-off valve (1*b*) for the other component.

6. Apparatus according to claim 5 characterised in that the supply (3; 4) of both the first component and also of the second component are each connected to a solvent supply pipe (1*c*; 2*c*).

7. Apparatus according to claim 5 or 6 characterised in that the shut-off valves (1*b*; 2*b*) can be operated by compressed air.

8. Apparatus according to one or more of claims 5 to 7 characterised in that the spray device (6) is connected to a compressed air pipe and forms the trigger device for initiating the discharge of the compressed air which takes place prior to the start of the mixing delivery.

9. Apparatus according to claim 8 characterised in that a quantity measuring device is mounted in the compressed air pipe and its signals are supplied to a memory-programmable control unit (5*a*) of the regulating device (5).

10. Apparatus according to one or more of claims 5 to 9 characterised in that the compressed air for the shut-off valves (1*b*; 2*b*) is controllable through magnetic valves (5*b*) which are controlled by the regulating device (5).

11. Apparatus according to one or more of claims 5 to 10 characterised in that a non-return valve (3*a*, 3*a*) is provided in each supply (3, 4) to the mixer device (7).

12. Apparatus according to one or more of claims 5 to 11 characterised in that the quantity measuring device (8, 9) is a through flow meter.

* * * * *